US009777535B1

(12) United States Patent
Stentiford, Sr.

(10) Patent No.: US 9,777,535 B1
(45) Date of Patent: Oct. 3, 2017

(54) STEP ADAPTOR FOR TRANSITIONING BETWEEN SECTIONS OF AN EXTENSION LADDER

(71) Applicant: Robert C. Stentiford, Sr., Ocala, FL (US)

(72) Inventor: Robert C. Stentiford, Sr., Ocala, FL (US)

(73) Assignee: STENTIFORD SAFETY SERVICES, LLC, Ocala, FL (US)

( * ) Notice: Subject to any disclaimer, the term of this patent is extended or adjusted under 35 U.S.C. 154(b) by 0 days.

(21) Appl. No.: 15/399,096

(22) Filed: Jan. 5, 2017

(51) Int. Cl.
*E06C 7/16* (2006.01)
*E06C 7/08* (2006.01)
*E06C 1/12* (2006.01)

(52) U.S. Cl.
CPC ..... *E06C 7/16* (2013.01); *E06C 1/12* (2013.01); *E06C 7/08* (2013.01)

(58) Field of Classification Search
CPC ..... E06C 1/12; E06C 1/38; E06C 7/06; E06C 7/08; E06C 7/16; E06C 7/165
See application file for complete search history.

(56) References Cited

U.S. PATENT DOCUMENTS 1,285,817 A * 11/1918 Sklar ..... E06C 7/165 182/120
1,615,135 A 1/1927 Putnam
1,820,315 A * 8/1931 Miller ..... E06C 7/165 182/122
2,415,327 A 2/1947 Yothers
2,528,317 A 10/1950 Newman et al.
2,726,901 A 12/1955 Newman et al.
2,876,047 A * 3/1959 La Plante ..... E06C 1/12 182/121
2,899,011 A 8/1959 Babits
(Continued)

FOREIGN PATENT DOCUMENTS

DE 3500148 A1 * 7/1986 ..... E06C 1/12
EP 1607570 A2 12/2005
(Continued)

OTHER PUBLICATIONS

"Guardian Fall Protection Ladder Rung Step," product information, Northern® Tool + Equipment, northerntool.com, Item# 50935, [online, webpage, accessed: Jul. 2016] from http://www.northerntool.com/shop/tools/product_200661628_200661628 Disclosing an aftermarket step for extension ladders (Photos), pp. 1-3.

(Continued)

*Primary Examiner* — Colleen M Chavchavadze
(74) *Attorney, Agent, or Firm* — Saliwanchik, Lloyd & Eisenschenk

(57) ABSTRACT

The problem of traversing the offset area between the fly section and the base section of an extension ladder is solved by a step adaptor of the subject invention. A step adaptor can have two or more steps which can be progressively narrower in depth. The step adaptor can be placed on the first available rung just below the fly section. The progressively narrower depth of the steps of a step adaptor create a transition zone in the offset area that reduces the abrupt change in distance between the rungs in the fly section and the rungs in the base section.

12 Claims, 6 Drawing Sheets

(56) References Cited

U.S. PATENT DOCUMENTS

| | | | | | |
|---|---|---|---|---|---|
| 3,112,811 | A | | 12/1963 | Moran | |
| 3,115,214 | A | * | 12/1963 | Roberts | E06C 7/165 182/120 |
| 3,276,543 | A | * | 10/1966 | Kanoza | E06C 7/081 182/122 |
| 3,294,197 | A | * | 12/1966 | Kwiatkowski | E06C 7/16 182/120 |
| 3,422,923 | A | | 1/1969 | Lund | |
| 3,503,468 | A | * | 3/1970 | Taylor, Sr. | E06C 7/16 182/121 |
| D256,618 | S | | 8/1980 | Klein | |
| D258,839 | S | | 4/1981 | Broyles | |
| 4,804,063 | A | | 2/1989 | Farris | |
| 5,094,319 | A | * | 3/1992 | Kobasic | E06C 7/16 182/121 |
| 5,337,857 | A | | 8/1994 | Bplat et al. | |
| 5,779,208 | A | | 7/1998 | McGraw | |
| D426,896 | S | | 6/2000 | Brown | |
| 6,786,300 | B1 | * | 9/2004 | Bonifacini | E06C 7/165 182/120 |
| 7,578,371 | B2 | * | 8/2009 | Allred, III | E04F 11/064 182/163 |
| D642,702 | S | | 8/2011 | Pelini | |
| D683,479 | S | | 5/2013 | Göransson et al. | |
| 8,657,070 | B2 | | 2/2014 | O'Brien et al. | |
| 8,727,074 | B1 | | 5/2014 | Bhajan | |
| D718,875 | S | | 12/2014 | Ramos Moreno et al. | |
| 2007/0068732 | A1 | * | 3/2007 | Nagle | E06C 7/16 182/121 |
| 2014/0326538 | A1 | | 11/2014 | Najey | |

FOREIGN PATENT DOCUMENTS

| | | | | | |
|---|---|---|---|---|---|
| FR | 2454511 | A1 | | 11/1980 | |
| FR | 2837234 | A1 | | 9/2003 | |
| GB | 1333291 | A | * | 10/1973 | E06C 7/08 |
| GB | 2185775 | A | | 7/1987 | |
| GB | 2245303 | A | * | 1/1992 | E06C 7/16 |
| WO | WO 2015/063467 | A1 | | 5/2015 | |

OTHER PUBLICATIONS

"Guardian 2477," product information, Acme Construction Supply Co., Inc., acmetool.com, UPC:012643024770, [online, webpage, accessed: Jul. 2016] from https://www.acmetool.com/index.jsp?path=product&part=88440&ds=dept&process=search&qdx=0&text=guardian, Disclosing accessory step for extension ladder (Photos), p. 1.

"Safety ladder rung cover/traction tread ladder rung cover," product information ECVV, ecvv.com, [online, webpage, accessed: Aug. 20, 2015] from http://www.ecvv.com/product/4498741.html Disclosing manufacturers of metal ladder tread covers (Photos), pp. 1-6.

* cited by examiner 14
12
16
17
30
32
35
70
72
73
75
78
80
410
8
10
90
92
93
95
98
415
75, 95

STEP ADAPTOR FOR TRANSITIONING BETWEEN SECTIONS OF AN EXTENSION LADDER

BACKGROUND OF INVENTION

Extension ladders, or telescoping ladders, usually have two side rails and multiple steps or rungs fixed between the two side rails. The two or more ladder sections, referred to as a base section and a fly section, can be slid longitudinally apart on the side rails to extend the fly section above the base section, or the sections can slide together over one another for convenient storage. When slid apart, the rungs of the fly section are significantly more forwardly disposed than the rungs of the base section. This creates an offset area between the base section and the fly section that must be climbed past when going up or down the ladder. This offset area increases the likelihood of missing a step on a rung in the offset area, when ascending or descending the ladder. Furthermore, when extending a leg to catch the top rung on the base section in the offset area, the bottom rung on the fly section, because it extends further out, can impede the leg or the leg can bump into the bottom rung on the fly section, making it difficult to reach the rung in the base section. A more easily traversable offset area between the base and fly sections of an extension ladder would improve the safety of such ladders.

BRIEF SUMMARY

In accordance with the subject invention, the problem of traversing the overlapping or offset area between the base section and the fly section of an extension ladder is solved by the use of a step adaptor that removably fits onto an extension ladder below the transition area. The offset area formed where the fly section overlaps the base section can create a recessed area under the fly section that can be 2-3 inches deep. This recessed or offset area can be difficult to climb over, going up or down the ladder. A step adaptor can alleviate the difficulty in traversing between ladder sections by providing a transition zone where there is a gradual change in the depth of the steps. This more gradual change in step depth can make it easier to position the feet on the rungs in the transition area.

A step adaptor can have multiple steps of graduated depths, with the top step being deeper, from front to back, than the narrower bottom steps. Advantageously, when attached to an extension ladder, the step adaptor is placed only on rungs in the base section and just below the fly section. Thus, the step adaptor does not engage with more than one section of an extension ladder, reducing the possibility of the step adaptor, in any way, affecting the locking mechanism that secures the extended ladder sections. Each step of the step adaptor also has a space or under-slot therein that allows the step to fit over a rung on the base section of the extension ladder. Thus, each step of the step adaptor is engaged over a rung of the base section, which inhibits the step adaptor from rotating or moving out of place. Furthermore, because all of the steps are engaged with rungs on the ladder, the weight of the step adaptor and any weight placed on the step adaptor can be distributed across the step adaptor and the extension ladder, reducing or eliminating stress points.

The steps of a step adaptor can be attached to two uprights with the top step being deeper, from front to back, than the steps below, which are gradually narrower. In one embodiment, a step adaptor has at least three steps where the depth of the steps is graduated, so each step is narrower than the one above. In a further embodiment, the top step on a step adaptor is narrower than the bottom rung of the fly section of the extension ladder. When climbing up or down an extension ladder with a step adaptor in place, the gradual change in depth of the steps forms a transition zone in the offset area of the ladder sections. When climbing up or down the ladder, the transition between the two sections can be almost unnoticeable and safer to climb over.

In one embodiment, the depth between the steps changes between approximately ¼ inch and approximately 1 inch between each step. In a further embodiment, the front of the steps are attached to the uprights so that the depths graduate along the front side of the step adaptor. At the back side of the step adaptor, the steps are aligned with the upright. When the steps are placed over the ladders rungs, the back of each step can be braced against the ladder rung that it goes over. Thus, each step is braced on the front side by the uprights and in the back by the rung that it goes over. This inhibits the step adaptor from sliding from front to back.

Not every extension ladder has the same dimensions. While there can be some uniformity in the distance between the steps, some ladders are wider than others between the side rails. In one embodiment, each step of a step adaptor has two slidingly engaged interleaves that can slide one over another to widen the steps between the rails. The interleaves can fit over the rungs of the ladder, as explained above, to keep the step adaptor steady and in place.

A step adaptor embodiment of the subject invention can form a transition zone between the base section and the fly section of an extension ladder. In certain embodiments, the step adaptor can be adjusted to accommodate extension ladders with different dimensions. Unlike previous devices intended to form a transition zone, the embodiments of the subject invention are not permanently attached to the ladder, but utilize the rungs to stabilize the step adaptor. Because a step adaptor can have multiple steps, the transition zone is larger than that of other devices, allowing for more gradual, less noticeable, and safer change in the depth of the steps. Furthermore, a step adaptor is placed only on the base section and does not overlap with the fly section. This can ensure that the step adaptor does not interfere with the locking mechanism that keeps the base section and the fly section in place.

This Brief Summary is provided to generally introduce one or more select concepts described below in the Detailed Disclosure in a simplified form. This Summary is not intended to identify key and/or required features of the claimed subject matter. Other aspects and further scope of applicability of the present invention will also become apparent from the detailed descriptions given herein. It should be understood, however, that the detailed descriptions, while indicating preferred embodiments of the invention, are given by way of illustration only, since various changes and modifications within the spirit and scope of the invention will become apparent from such descriptions. The invention is defined by the claims below.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which:

FIG. 2A shows the components of an over-leaf and example width dimensions. FIG. 2B shows the components of an under-leaf and example width dimensions. FIG. 2C illustrates an example of an under-leaf with a back-lip slanted towards the front lip to provide a friction fit with a ladder step.

FIG. 3A shows an upright with the over-leafs attached. FIG. 3B shows another, opposite upright with the under-leafs attached.

FIG. 4A shows a step with tabs on the front edge of the over-leaf and the front edge of an under-leaf.

FIG. 4B shows alternative embodiments of locations for tabs along an outside edge of either an over-leaf or an under-leaf.

FIG. 5A illustrates an enlarged view of a portion of an under-leaf, with a tab on the front edge and a slidable connector groove. FIGS. 5B and 5C show embodiment of tabs on the front edge of an over-leaf and an under-leaf, respectively, where the tabs have bends that allow them to fit into the slots on an upright. FIG. 5D shows an alternative embodiment of a slidable connector.

DETAILED DISCLOSURE

Figure 1:
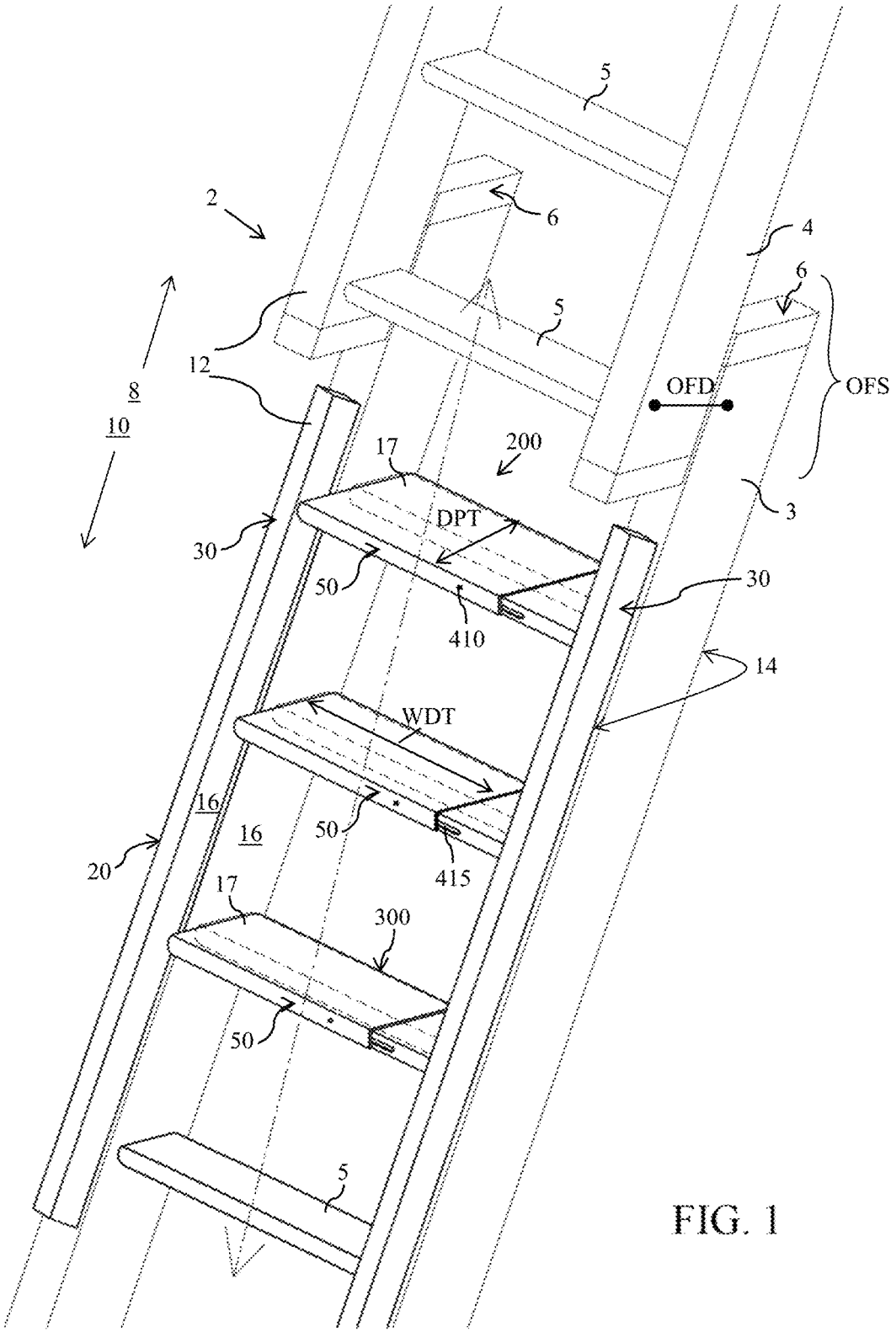
FIG. 1 is an illustration of an extension ladder with the fly section raised and an embodiment of a step adaptor, according to the subject invention, placed on the steps of the base section.

The subject invention pertains to a device for reducing the offset between the fly section and the base section of an extension ladder. More specifically, the subject invention provides one or more embodiments of a step adaptor, or similar device, capable of graduating the depth of the steps below the fly section of an extension ladder. The graduation in the depth of the steps can alleviate the abrupt transition between the two ladder sections.

The following description will disclose that the subject invention is particularly useful with ladders, in particular extension ladders with two or more sections that extend apart resulting in a offset area between two ladder sections. A person with skill in the art will be able to recognize numerous other uses that would be applicable to the devices and methods of the subject invention. So, while the subject application describes, and many of the terms herein relate to, a use on extension ladders, the invention is not limited to use only on ladders or extension ladders.

In the description that follows, a number of terms used are utilized. In order to provide a clear and consistent understanding of the specification and claims, including the scope to be given such terms, the following definitions are provided.

As used herein, the terms "ladder" and "extension ladder" are used interchangeably and refer to any ladder with two or more sections that slide or pull apart to increase the length of the ladder. Specifically, it refers to ladders on which one or more offset areas are formed when the two or more sections are slid or pulled apart.

Also, as used herein, and unless otherwise specifically stated, the terms "operable communication," "operable connection," "operably connected," "cooperatively engaged" and grammatical variations thereof mean that the particular elements are connected in such a way that they cooperate to achieve their intended function or functions. The "connection" or "engagement" may be direct, or indirect, physical or remote.

It is to be understood that the figures and descriptions of embodiments of the present invention have been simplified to illustrate elements that are relevant for a clear understanding of the invention, while eliminating, for purposes of clarity, other elements that may be well known.

Those of ordinary skill in the art will recognize that other elements may be desirable and/or required in order to implement the present invention. However, because such elements are well known in the art, and because they do not facilitate a better understanding of the present invention, a discussion of such elements is not provided herein.

Finally, reference is made throughout the application to the "top end" and "bottom end." As used herein, the top end is that end furthest away from the ground or other surface on which a ladder stands. Conversely, the bottom end is that end closest to or against the ground or other surface against which a ladder stands.

The present invention is more particularly described in the following examples that are intended to be illustrative only since numerous modifications and variations therein will be apparent to those skilled in the art. As used in the specification and in the claims, the singular for "a," "an" and "the" include plural referents unless the context clearly dictates otherwise.

Reference will be made to the attached figures on which the same reference numerals are used throughout to indicate the same or similar components. With reference to the attached figures, which show certain embodiments of a the subject invention, it can be seen in FIG. 1 that embodiments of a step adaptor 20 of the subject invention have at least two uprights 30, at least two steps 50, each with an over-leaf 70 and an under-leaf 90, that operably connects to the over-leaf. Each of these general components can have one or more sub-components, which will be discussed in detail below.

The materials that can be utilized for the components of a step adaptor can vary. The Occupational Safety and Health Administration (OSHA) has specific requirement for the construction of extension ladders. Specifically, 29 CFR §1926.1053(a)(1)-(a)(27) outlines the structural requirements for extension ladders to meet OSHA safety standards. Advantageously, the steps of a step adaptor overlap with the rungs of an extension ladder. Thus, most if not all of the weight applied to the steps can actually be supported by the underlying rung. As such, the uprights can have sufficient strength to hold the steps in position, but do not have to be configured to support the entire weight of a person or the same weight mandated by OSHA standards, as discussed above. However, in certain circumstances, it can be beneficial if the materials, ranges of dimensions, extension ranges, and range of capacity for a step adaptor of the subject invention comply, as much as possible or reasonable, with OSHA standards for extension ladders.

In general, a step adaptor 20 can be an attachment or accessory that removably couples to an extension ladder. A step adaptor can have at least two uprights to which at least two steps, ideally at least three steps, can be fixedly attached. As shown in FIG. 1, the uprights rest against the side rails 6 of the base section 3 of an extension ladder, after extension of the fly section 4. More specifically, when a step adaptor is installed on an extension ladder, the uprights have a back side 14 that rests against a front side 12 of the extension ladder side rails. The steps decrease gradually in depth DPT between the top step 200 and the bottom step 300. When the uprights are in place against the side rails, the steps 50 of a step adaptor can overlap rungs 5 on the ladder, thereby gradually decreasing the offset distance OFD between the rungs of an extension ladder.

Figure 6:
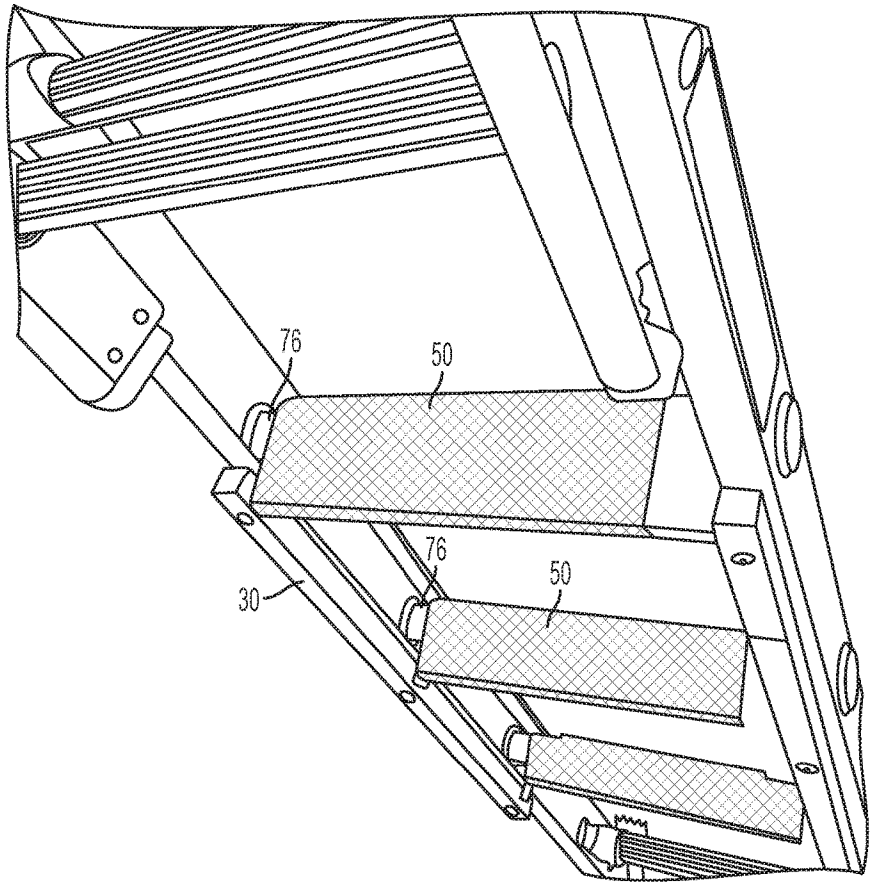
FIG. 6 is a photograph of an extension ladder with an embodiment of a step adaptor placed on the base section, below the fly section.

When a fly section 2 of an extension ladder is moved up on the base section 3, there is formed an offset area, as shown in FIGS. 1 and 6, where the last rung in the fly section overlaps is forward of the first available rung in the base section by approximately 2" to approximately 4," depending upon the specific ladder. It is this offset area that the step adaptor embodiments of the subject invention are able to correct, making the offset area easier to traverse across.

In general, an upright 30 is a post, pole, tube, rod, shaft, or the like, that can rest against the ladder side rails and to which the steps 50 can be attached. The uprights can be solid or hollow, which can depend upon how the steps 50 are attached. It can be helpful for the uprights to have dimensions that present a low profile on the side rails 6, so as to not interfere with traversal of the ladder. Alternatively, the uprights can include any of a variety of handles, structures, or fixtures for grabbing or holding onto when traversing the step adaptor on a ladder. Such handles, structures and fixtures are known in the art and are within the skill of a person trained in the art to select and include on a step adaptor.

In one embodiment, the uprights 30 are elongated tubular shafts. FIGS. 1 and 6 illustrate non-limiting examples of uprights that rest against the side rails of an extension ladder without overlapping the climbing area or rising more than necessary above the side rails, thus presenting a generally low profile. In one embodiment, the uprights are square tubular shafts with sides that are at least 0.60", 0.70", 0.80", 0.85", 0.95", 1.0", 1.10", 1.20", 1.30", 1.40" and/or 1.50" or having sides that are in a range between any two of the listed values. In a further embodiment, the uprights have a length of at least, 15", 16,", 17", 18", 19", 20", 21", 22", 23", 24", 25", 26", 27", 28", 29" and/or 30," or a length in a range between any two of the listed values. In a specific embodiment, the uprights are aluminum tubing approximately 1" square with walls that are between approximately 1/16" and 1/4" thick.

The rungs of an extension ladder, or any other type of ladder, are usually not parallel to the side rails, particularly if the rungs have a flat surface for stepping on during climbing. This is because when the extension ladder is placed against a vertical surface or object, the flat stepping surface should be parallel with the ground or other surface that the ladder sits on. Typically, the front side 12 of the rungs is tilted downwards, so that when the side rails are angled to rest against the vertical surface, the steps are positioned parallel to the ground. The amount that the rungs are tilted can depend upon the length of the ladder and the angle, or range of angles, at which the ladder can safely be positioned against a surface.

Likewise, the steps 50 of a step adaptor 20 can also be tilted to match or substantially match the tilt of the extension ladder rungs. In one embodiment, the front side 12 of the steps is tilted downward between approximately 10° and approximately 50°. In a more specific embodiment, the front side of the steps is tilted downward between approximately 20° and approximately 40°. In yet a further specific embodiment, the front side of the steps is tilted downward between approximately 25° and approximately 30°.

The steps 50 of a step adaptor can be fixedly attached to the uprights by any of a variety of devices and techniques known in the art. For example, the steps can be welded to the uprights, bolted to the uprights, screwed to the uprights, any of various other types of inserts can be used, or they can be attached by any other devices and techniques that will secure the steps to the uprights. In a specific embodiment, carriage bolts, other non-removeable bolts, or rivet-type connectors can be used to secure the steps to the uprights. A person with skill in the art can determine an appropriate device and technique for attaching the steps, taking into consideration a variety of factors such as, for example, the material of the uprights and steps, the dimensions of the uprights and steps, the tilt at of the steps, and other factors. Such variations are within the scope of this invention.

There can be variation in the width WDT between the side rails of different extension ladders. In order to accommodate different dimensioned extension ladders, embodiments of a step adaptor can be configured to have different widths between the uprights. The appropriate step adaptor can be selected with a particular width for use with an extension ladder also having a specified width between the uprights.

Alternatively, the steps 30 of a step adaptor can be configured as adjustable, such that the width WDT can be changed or adjusted to accommodate a variety of different width extension ladders. In one embodiment, a step 30 can have at least one over-leaf 70 and at least one under leaf 90 that are interleaved with each other, such that one is positioned over the other. With this embodiment, the uprights can be pulled apart or pushed together to slide the over-leaf over the under-leaf and adjust the width of the steps.

Figures 2A, 2B, 2C:
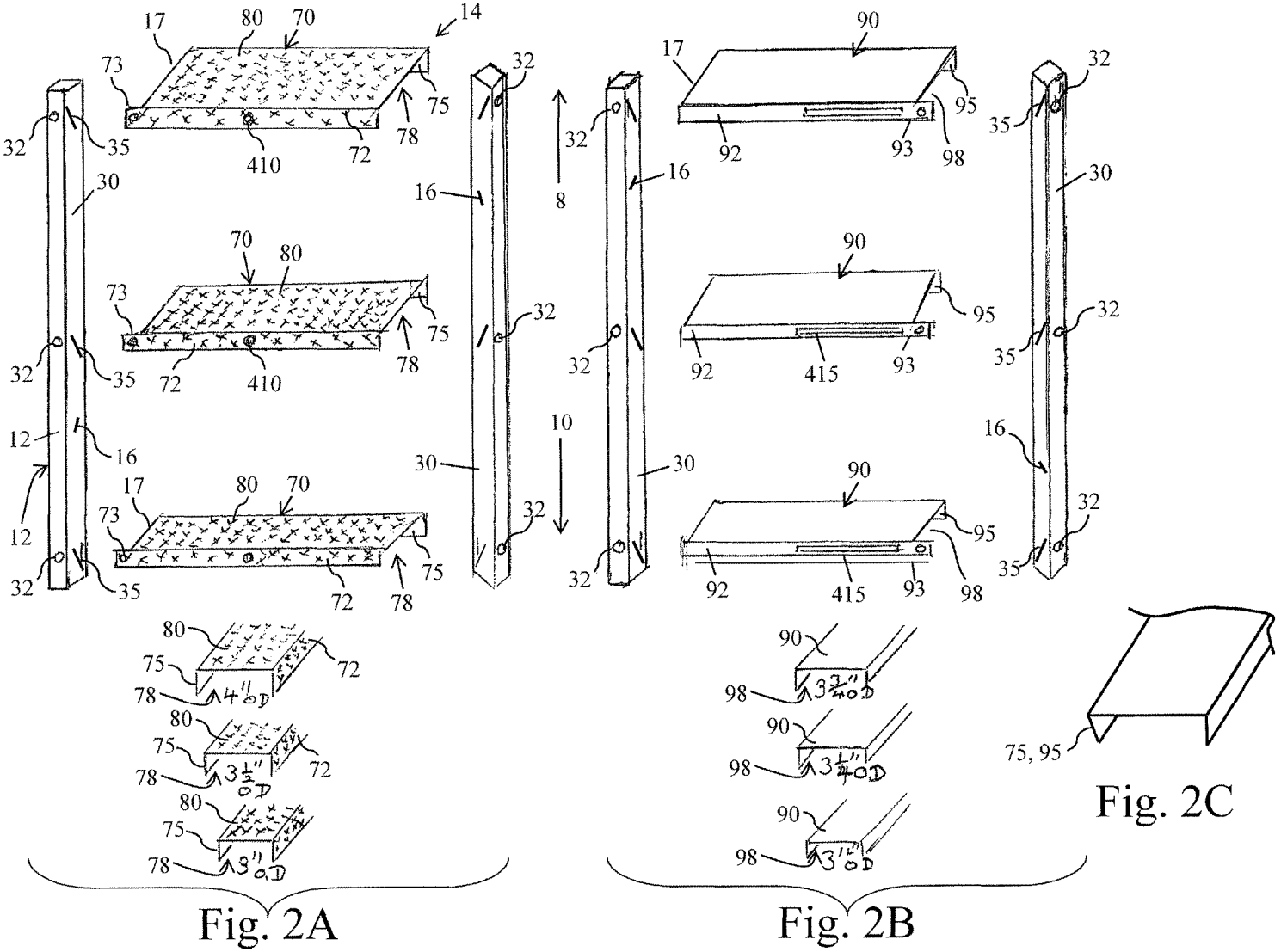
FIGS. 2A, 2B and 2C illustrate exploded views of a step adaptor embodiment, according to the subject invention.
Figure 4B:
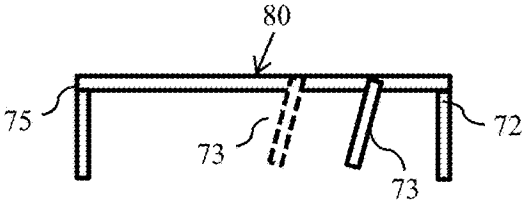
FIGS. 4A and 4B illustrate a step and embodiments of different tab locations.
Figure 4A:
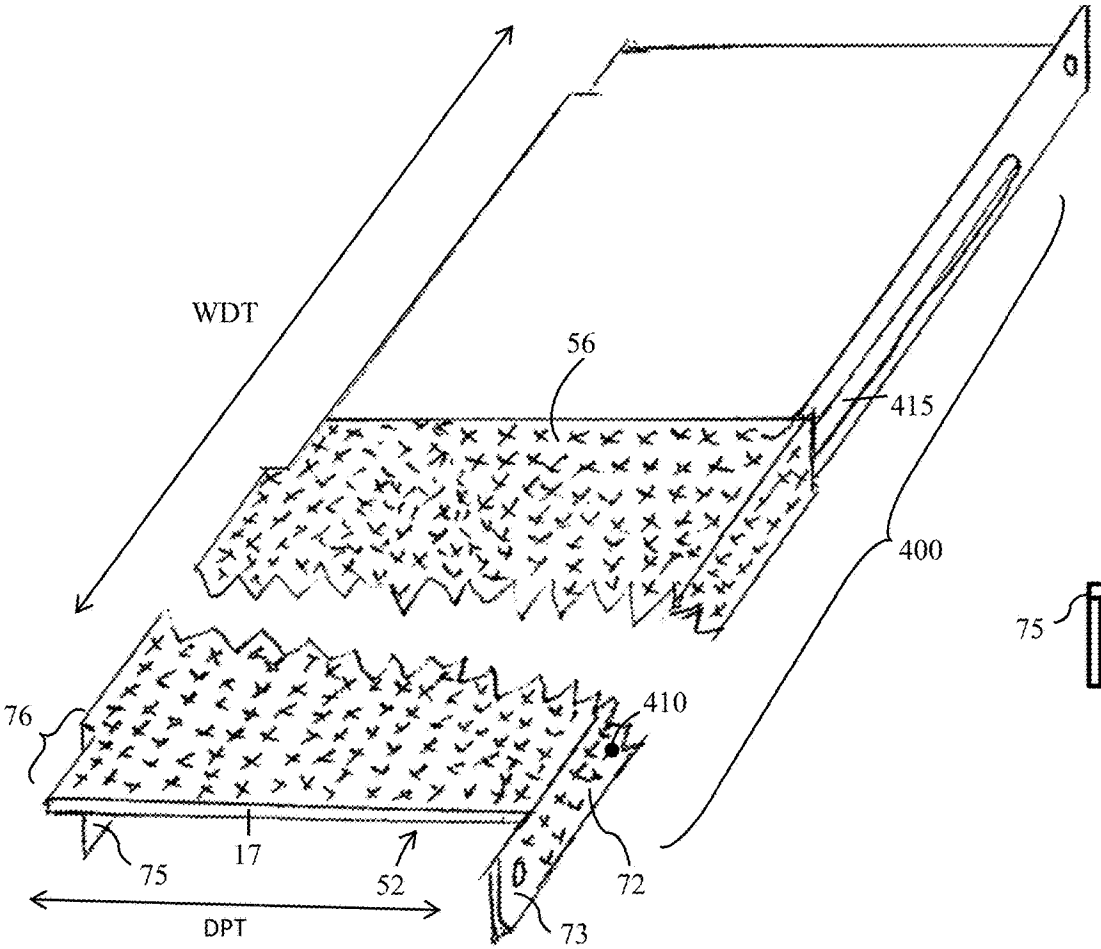

In one embodiment, an over-leaf 70 has a step plate 80 with a front lip 72 attached thereto, that protrudes towards the bottom end 10 of the step adaptor 20 and extending along all or some portion of the front side 12, as shown, for example, in FIGS. 2A and 4A. In a further embodiment, an over-leaf has a back lip 75 attached thereto, also protruding towards the bottom end and extending along all or some portion of the back side 14, substantially opposite to the front lip. In one embodiment, the back lip extends across a portion of the back side, leaving at least one cut-out 76 at an outside edge 17, where the over-leaf abuts the side rail of the extension ladder. The cut-out can accommodate the shape of the side rails, allowing the over-leaf to be placed as close as possible to the inside surface 16 of a side rail. FIG. 6 illustrates a non-limiting example of a step adaptor with over-leaf cut-outs 76 that allow the step to be widened to the full width of the ladder rungs.

In a further embodiment, the step plate 80, front lip 72, and back lip 75 form an under-slot 78, which is a recessed area within the bottom end 10 of the step. When the step adaptor is placed on an extension ladder, the under-slot in each step rests upon a rung 5 of the ladder. In one embodiment, the front lip and back lip of the over-leaf are substantially perpendicular to the step plate and the slide plate.

Beneficially, this allows the under-slot of the step adaptor to be set onto the rungs of a ladder with little or no effort and without having to exert force to fit the steps onto the rungs. One example of this is shown in FIGS. 1 and 2A. In an alternative embodiment, one or both of the front lip and back lip are angled slightly towards the other, which can provide a friction fit with the rung. FIG. 2C illustrates an example of a back lip angled towards the front lip to provide a friction fit.

Attachment of an over-leaf to an upright can be accomplished by several methods. As mentioned above, steps and can be fixedly attached to the uprights by any of a variety of devices and techniques known in the art. For example, the steps can be welded to the uprights, bolted to the uprights, screwed to the uprights, any of various other types of inserts can be used, or they can be attached by any other devices and techniques that will secure the steps to the uprights. In a specific embodiment, carriage bolts, other non-removeable bolts, or rivet-type connectors can be used to secure the steps to the uprights. These same techniques can be applied to the attachment of an over-leaf to an upright.

Figure 5D:
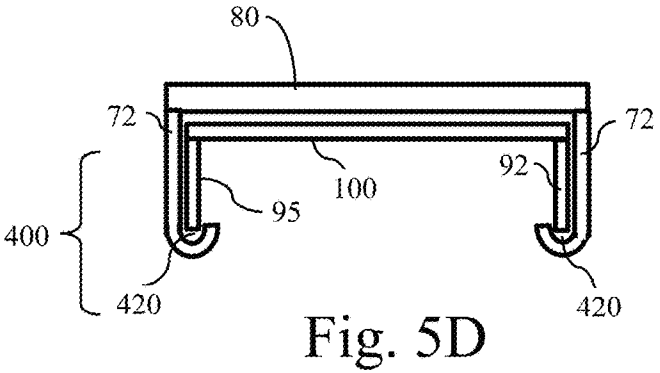
FIGS. 5A, 5B, 5C, and 5D show embodiments of specific components of a step.
Figure 5A:
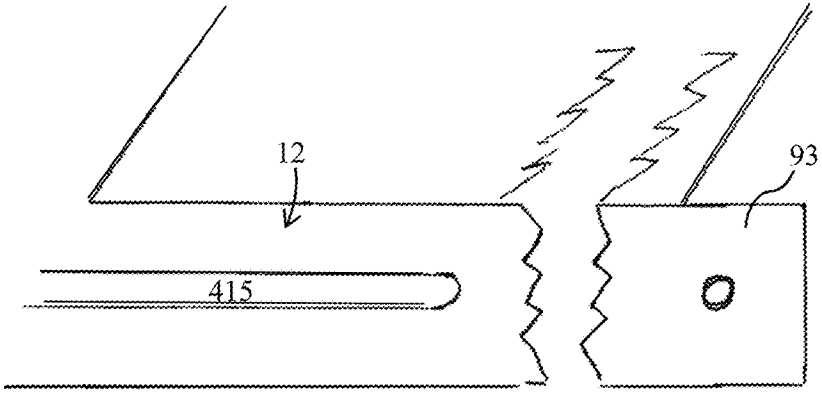
Figure 5C:
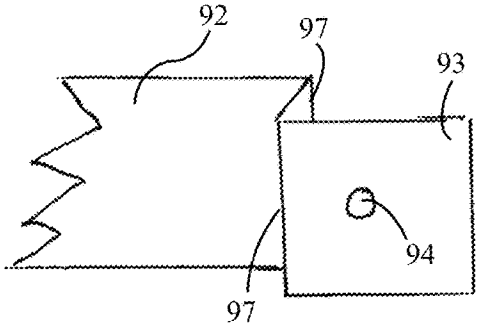
Figure 5B:
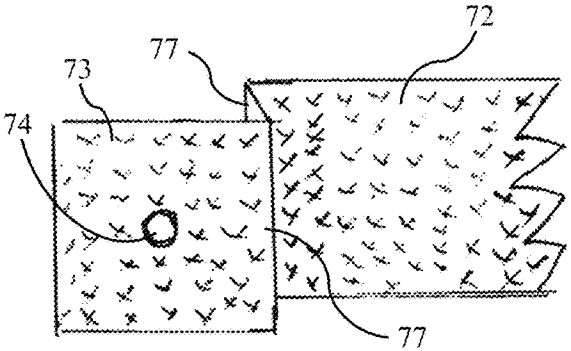

An over-leaf can also have one or more structures thereon that allow it to be fixedly attached to an upright. In one embodiment, an over-leaf can have a tab 73 extending from the outside edge 17 that can be utilized to attach the over-leaf to an upright. FIGS. 2A and 4A illustrate non-limiting examples of a tab 73 that extends from the outside edge of the front lip. In one embodiment, the tab extends straight out from the outside edge 17 of the front lip, such that it is coplanar or in line with the front lip, as shown in FIGS. 2A and 4A. In an alternative embodiment, the tab can have one or more bends 77, such that all, or some portion thereof, is not coplanar with the front lip, an example, of which, is shown in FIGS. 5B and 6. The tab can be used to attach the over-leaf to the upright. As will be discussed in more detail below, the steps of a step adaptor change depth from the top end 8 to the bottom end. The use of a tab with one or more bends can facilitate attachment of the less deep steps to an upright.

Figure 3B:
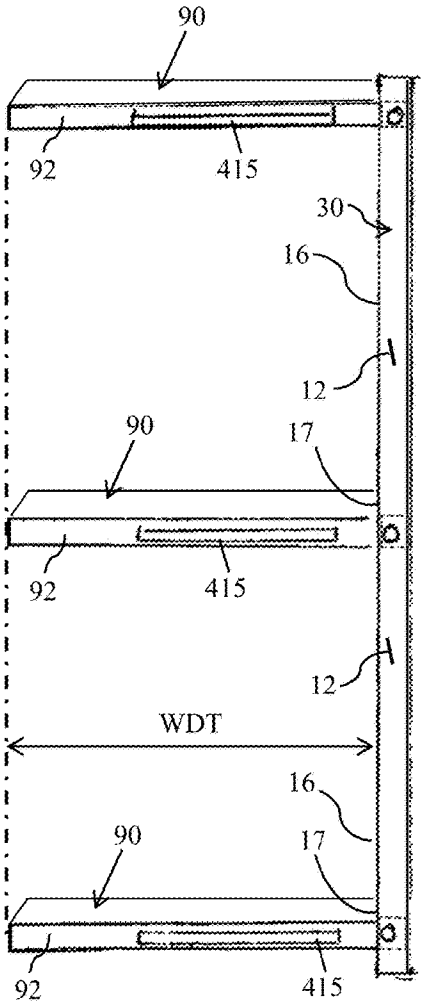
FIGS. 3A and 3B illustrates a partial exploded view of a step ladder embodiment.
Figure 3A:
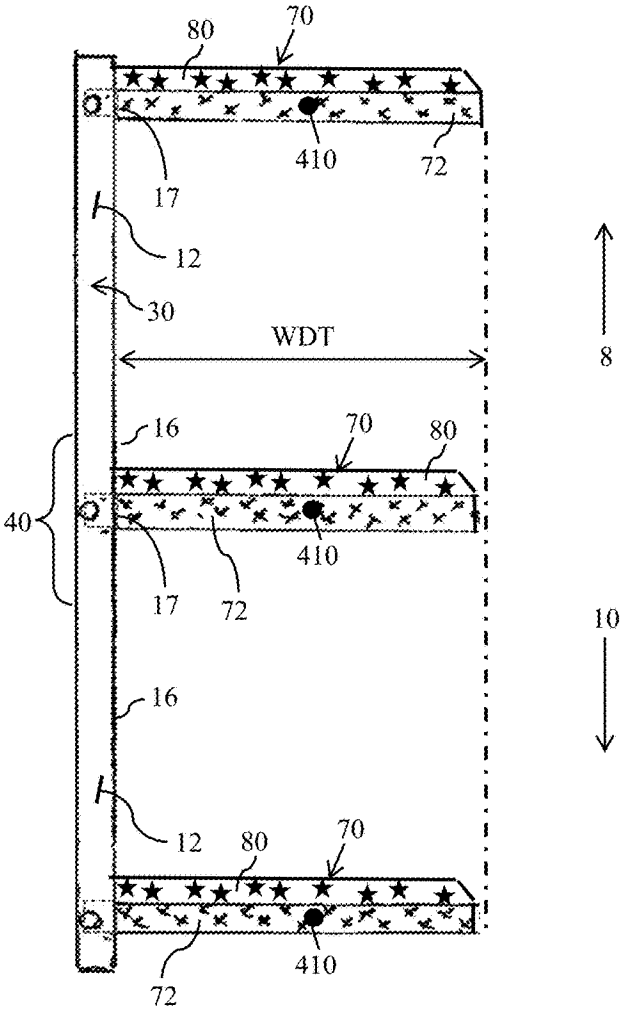

In one embodiment, the tab overlaps the front side 12 of the upright so that any of a variety of connectors can be used to screw, pin, bolt, or otherwise fix the tab onto the front side of the upright. In a specific embodiment, carriage bolts, other non-removeable bolts, or rivet-type connectors can be used to secure the steps to the uprights. In a further embodiment, an upright has one or more bores 32 therein to facilitate attachment of the tabs with a connector. FIG. 2A shows an exploded view of a step adaptor 20 with a tab 73 on the over-leaf. In this Figure, the uprights are shown with bores 32 and the tab is shown with holes 74 that can be aligned with the bores for fixing the tab onto the inside of the upright. In FIG. 3A, there is shown one example of a tab front-side attached 40 to an upright.

In an alternative embodiment, the upright 30 has slots 35 along the inside surface 16 of the upright, which is shown, by way of example, in FIG. 2A. In a further alternative embodiment, the slots are in alignment with the bores 32 in the uprights. With this embodiment, the tab 73 on an over-leaf 70 can be inserted into a slot 35 so that the bore 32 aligns with the hole 74. Any suitable connector apparatus can be inserted through the bore and into the hole to keep the tab secured within the slot. In one embodiment, a bolt, or similar type of connector, is inserted through the bore and into the hole in the tab. Tightening of the bolt draws the tab towards the bore, imparting tension on the tab that inhibits the tab from backing out of the slot.

As discussed above, the steps 50 of a step adaptor 20 can be angled or tilted to accommodate the angle or tilt of the rungs on an extension ladder. To achieve this angle, the steps can be attached by any of the methods described above so that they are at the prescribed angle.

In one embodiment, where tabs 73 are used, the top end 8 of the slots is tilted more towards the front end of an upright, such that the slots are not parallel with the sides of the uprights. FIG. 2A illustrates an example of slots having the top end 8 tilted towards the front side of the upright. In a further embodiment, the slots are tilted between approximately 10° and approximately 35°. In a particular embodiment, the slots are tilted between approximately °15 and 25°. In a specific embodiment, the slots are tilted approximately 15°.

With this embodiment, the tabs can be aligned with or be coplanar with the front lip, as illustrated in FIG. 4A. The over-leaf can be rotated slightly so that the tab can fit into the tilted slot in the upright. This causes the back side 14 of the over-leaf 70 to rise up, giving a tilted aspect to the entire step, when the uprights are vertical, which is shown, by way of example, in FIG. 3A. When the extension ladder is tilted into position for use and a step adaptor likewise tilted and placed thereon, the rungs and steps can be positioned substantially, or at least sufficiently, parallel to the ground for climbing.

The location of the slots 35 in the inside surface 16 of the uprights can depend upon the depth DPT of the steps, which is discussed below. The backside of the step and the back lip 75 are positioned against the back side of the ladder rung. This means that the attachment of the tab to the upright should be positioned to keep the back lip against the backside of the rung. In one embodiment, the slots are aligned, one above the other in the uprights and the location of the tabs on the step 30 is adjusted to fit into the slots and maintain the position of the back lip against the backside of the rung. FIG. 4B illustrates an example of this embodiment, showing alternative positions for tabs along the outside edge 17. In an alternative embodiment, the tabs 73 on a step extend out from the front lip, as described above, and the positions of the slots in the uprights are adjusted to accommodate differences in step depths. FIGS. 1, 2A, and 2B illustrate example of an upright where the slots move progressively closer to the back side 14 of the upright to accommodate steps that have progressively less depth DPT. The ability to determine the appropriate position of the slots in the uprights and the tabs on a step is within the capability of one of ordinary skill in the art.

The width WDT of a step can be adjusted by coupling the over-leaf 70 and under-leaf 90, so that they slide across each other, in a telescoping fashion. In one embodiment, an under-leaf is similar to an over-leaf, in that there are similar or identical components. In one embodiment, an under-leaf is a mirror-image or substantially a mirror-image of an over-leaf, with dimensions such that the under-leaf can be made to fully or partially telescope with and slide within the over-leaf. In a specific embodiment, the under-leaf and the over-leaf are interdigitated. One example of an under-leaf slidably coupled within an over-leaf is shown in FIG. 4A. The factors that can be considered by those skilled in the art with regard to the over-leaf embodiments have been discussed above and are reiterated here with regard to the under-leaf embodiments. Thus, an under-leaf can also have a front lip 92, a back lip 95, and a step plate 100, as described above with regard to embodiments of an over-leaf. These components can also form an under-slot 98 for going over a rung of an extension ladder. When the under-slot 78 of an over-leaf is slidingly coupled with the under-slot 98 in an under-leaf, such that they are integral with each other, there is formed a full step 50 with an adjustable rung channel 52 on the bottom end 10 of a step that can go over the rung of an extension ladder. The width of the rung channel can be adjusted by sliding the under-leaf and the over-leaf over each other.

As with an over-leaf, an under-leaf can be fixedly attached to another upright, opposite to the upright to which an over-leaf can be attached. In one embodiment, an under-leaf has a tab 93 that extends from the outside edge 17 of the under-leaf. Embodiments of a tab have been discussed above and are applicable to embodiments of a tab 93 on an under-leaf. For example, an under-leaf tab 93 can extend straight out from the outside edge of the front lip 92, such that the tab is coplanar or in line with the front lip. The attachment of a tab 93 to another upright can be achieved in the same manner as the attachment of a tab 73 on an over-leaf to an upright 30. In one embodiment, the tab 93 of an under-leaf is inserted into a slot 35 in an upright. The slot 35 in the upright and the insertion of the tab 93 on an under-leaf can be the same at described above for the insertion of a tab 73 on an over-leaf into slots 35 on an upright. In one embodiment, the tab 93 has a hole 94 and the upright has a bore 32 that can be aligned with the hole, such that a connector can be inserted through both to secure the tab to the upright. FIGS. 2B and 3B illustrate embodiments of an under-leaf with a tab and an upright having slots for receiving the tabs and in which the tabs can be fixedly attached. FIG. 3B illustrates a plurality of under-leafs attached to an upright. Conversely, FIG. 3A illustrates a plurality of over-leafs attached to another upright. It can be seen in these figures that over-leafs and under-leafs are attached to opposite uprights.

The over-leaf 70 and the under-leaf 90 can be connected to keep them attached and increase their stability when used on an extension ladder. In one embodiment, an over-leaf and an under-leaf are attached by a slidable connector 400 that not only keeps them attached, but facilitates adjustment of the step width. There are numerous types of slidable connector configurations and devices known in the art. By way of non-limiting example, FIG. 5A shows a pin and groove slidable connector, where the over-leaf has a pin 410 that fits into a groove 415 in the under-leaf. The pin keeps the over-leaf attached to the under-leaf and the groove allows the pin to slide between the outside edges 17. By way of another non-limiting example, a gutter 420 can be formed at the bottom end 10 of one or both of the front lip 72 and the back lip 75 of an over-leaf. The bottom end of one or both of the front lip 92 and the back lip 95 of an under-leaf can be placed into a gutter. The gutter maintains the position of the front lip and back lip therein and allows the over-leaf and under-leaf to slide over each other. There are other slidable connector configurations known to those with skill in the art. Such variations are within the scope of this invention.

The width WDT of a ladder can vary depending upon intended use, materials utilized, the maximum extension length, and other factors known to those with skill in the art. OSHA regulations mandate that "the minimum clear distance between side rails for all portable ladders shall be 11½ inch (29 cm)." (29 CFR §1926.1053(a)(4)(ii)). Thus, it can preferable, though not required, for variations in extension length to stay within ranges mandated by OSHA standards.

When a step adaptor is installed on a ladder, the uprights 30 can be placed against the side rails of an extension ladder. The uprights can support the steps and inhibit movement of the step adaptor on an extension ladder. Preferably, the uprights are positioned so that they are centered or approximately centered on the side rails. Thus, when adjusting the width WDT of the steps 30 of a step adaptor, the position of the uprights relative to the side rails should be taken into consideration.

In one embodiment, the under-leaf and over-leaf can be adjusted to provide a step 30 width WDT of between approximately 11" and approximately 24". In a more particular embodiment, the under-leaf and over-leaf can be adjusted to provide a step width of between approximately 12" and approximately 15".

Figure 7:
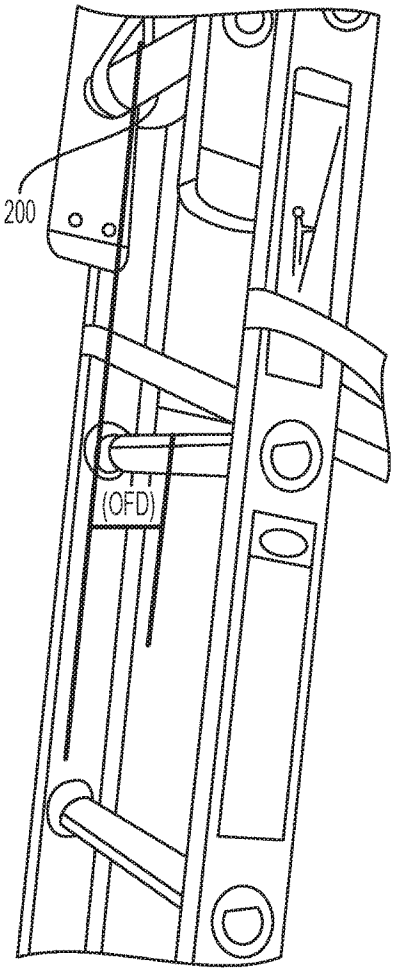
FIG. 7 is a photograph of an extension ladder from a side perspective view to illustrate the offset distance between the rungs on the fly section and the rungs on the base section.

In a typical offset area OFS, the offset distance OFD, which is the horizontal distance between the last rung on the fly section 4 and the first rung on the base section 3, can be several inches, as shown in FIG. 7. Mostly commonly, though not exclusively, this distance can between approximately 2" and approximately 2.5." The embodiments of a step adaptor 20 of the subject invention can form a transition between the steps in an offset area that makes it easier to traverse across this offset distance when climbing an extension ladder. The steps of a step adaptor can change the abrupt difference in the offset distance into smaller increments that are easier to traverse.

In one embodiment, the depth of the steps of a step adaptor gradually decreases from the top step 200 to the bottom or last step 300 on a step adaptor. The depth DPT of a step is a measure of the distance between the front side 12 and the back side 14 of the step plate 80 on an over-leaf. The amount of decrease in the step depth can depend upon the offset distance. In one embodiment, the decrease in depth, from the top step to the bottom step, is by equal amounts. For example, the depth of each successively lower step can be reduced by between approximately ¼" to approximately 1.5".

In a further embodiment, the top step 200 of a step adaptor has a depth that is between approximately ¼" to approximately 1.5" less than the total depth of the offset distance OFD. Thus, for example, if the offset distance OFD is 3", then the depth DPT of the top step 200 can be between approximately 2¾" to 1.5". The depth of each successively lower step can also be between approximately ¼" and 1.5" smaller than the step above. In a more specific embodiment, the depth of each successively lower step can be reduced by between approximately ½" to approximately ¾". FIG. 2A illustrates an example of a step where the over-leaf 70 decreases in depth by about ½" from the top step 200 to the bottom step 300. FIG. 2B demonstrates an example of how the under-leaf dimensions can be slightly smaller than the dimensions of the over-leaf, such as the over-leaf shown in FIG. 2A. Also shown is how the over-leaf can slidably interdigitation with the over-leaf.

Following is an example that illustrates an embodiment of the subject invention. This example is provided for the purpose of illustration only and should not be construed as limiting. Thus, any and all variations that become evident as a result of the teachings herein or from the following example are contemplated to be within the scope of the present invention.

Example 1: Step Adaptor for Use on Extension Ladder

A common household use extension ladder has rungs that are approximately 15¾" wide and side rails that are approximately 2¼" wide, giving the extension ladder an overall width of about 18". When the fly section is moved up on the base section, there is formed an offset distance, due to the depth of the side rails, between top rungs and lower rungs of about 2⅜." This offset distance is sufficient to make climbing and descending the ladder more difficult between the sections. Installing a step adaptor, having multiple, gradually narrowing steps, can reduce this offset distance to about ½ inch between each step, minimizing the effects of the offset distance.

A step adaptor, such as shown in FIG. 6, can have uprights of aluminum 1"×1" square tubing, with a ⅛" thickness to the walls. The uprights can be approximately 28" in length and capped at both ends. The inside walls of the uprights, which face the steps, can have vertical slots that are approximately 12" apart. A step adaptor can have three adjustable width steps.

Additional steps can also be used by lengthening the uprights and including additional slots. Each step can have a tab extending from the outside edge on either side that can be inserted into the slots and secured with a bolt through the tubing and the tab. Thus, there is tab extending from the over-leaf and a tab extending from the under-leaf, where each tab is engaged with a slot in an upright on either side of the step.

The steps can have an over-leaf made of an approximately 0.63 gauge aluminum diamond plate. The under-leaf that slidably couples below the over-leaf can be of an approximately 0.63 gauge smooth finish aluminum plate. The dimensions of the under-leaf are approximately ⅛" smaller than those of the over-leaf, so that the under-leaf can slide under the over-leaf. This allows the width of the steps to be adjusted to accommodate variations in width of rungs between different extension ladders. Typically, the steps can be adjusted to widths between 12" and 15", which should accommodate the width of most extension ladder steps.

When a step adaptor is placed on an extension ladder, the uprights are placed on the front side of the ladder side rails. The top step is placed on the first rung of the base section and just below the fly section and the lower steps are simultaneously placed on the lower rungs. The steps of the step adaptor have different depths, which is the distance from the front to the back of the step. The top step can be narrower than the last rung of the fly section, with each successively lower step about ½" Narrower than the Step Above it. A Step Adaptor Having Three steps can have the top step be approximately 5¾" deep, the middle step can be approximately 5¼" deep", and the bottom step can be 4¾" deep.

The steps are arranged on the uprights so that the steps get progressively narrower on the front side of the step adapt, as shown in FIG. 6. Thus, the back edges of the steps are aligned with the back side of the ladder and the front sides of the steps are not aligned with the front side of the ladder. The position of the slots in the uprights can be adjusted to accommodate the different depths of the steps. FIG. 6 shows the slots progressively moved further towards the back side of the uprights, so that tabs near the front side of the narrower, lower steps can be inserted into the slots.

When the step adaptor is placed on an extension ladder, the gradual change in step widths is easier to traverse. The step adaptor can be used by placing it over the steps of the extension ladder and does not require additional securing mechanisms to hold it in place.

All patents, patent applications, provisional applications, and other publications referred to or cited herein are incorporated by reference in their entirety, including all figures and tables, to the extent they are not inconsistent with the explicit teachings of this specification. Additionally, the entire contents of the references cited within the references cited herein are also entirely incorporated by reference.

Any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

I claim:

1. A step adaptor, adapted to be placed on an extension ladder, the step adaptor comprising:

a first upright for positioning on a side rail of the extension ladder and a second upright for positioning on another side rail of the extension ladder;

a top step attached between the first upright and the second upright and a plurality of lower steps attached between the two uprights and below the top step, where the top step and each lower step comprise, an over-leaf having:

a front lip, a step plate attached to the front lip, the step plate having a bottom side and an outside edge, and an underslot on the bottom side of the step plate, an under-leaf slidably attached to the over-leaf, the under-leaf having:

a front lip, a back lip, a step plate between the front lip and the back lip, the step plate having a bottom side and an outside edge, wherein the under-leaf step plate is positioned against the bottom side of the over-leaf step plate with the outside edge of the under-leaf opposite to the outside edge of the over-leaf, and an underslot on the bottom side of the under-leaf, overlapping with the underslot of the over-leaf, forming a rung channel when the step plates are positioned against each other, and wherein the depth of the top step is larger than the depth of each of the plurality of lower steps and further wherein the depth of each lower step, of the plurality of lower steps, is larger than the depth of the next lower step therebelow.

2. The step adaptor, according to claim 1, wherein the plurality of lower steps consists of a first lower step and a second lower step below the first lower step.

3. The step adaptor, according to claim 1, further comprising a slidable connector for coupling the over-leaf to the under-leaf.

4. The step adaptor, according to claim 3, further comprising a tab on the over-leaf for attaching the over-leaf to the first upright and a tab on the under-leaf for attaching the under-leaf to the second upright.

5. The step adaptor, according to claim 2, wherein the depth of the first lower step is between approximately ¼" and approximately 1.5" less than the depth of the top step.

6. The step adaptor, according to claim 5, wherein the depth of the second lower step is between approximately ½" and approximately 1" less than the depth of the first lower step.

7. The step adaptor, according to claim 5, wherein the depth of the second lower step is between approximately ½" and approximately ¾" less than the depth of the first lower step.

8. The step adaptor, according to claim 1, wherein the depth of the top step is less than the depth of the offset distance between a fly section and a base section of the extension ladder.

9. The step adaptor, according to claim 8, wherein the depth of the top step is between approximately ¼" and approximately 1.5" less than the depth of the offset distance.

10. The step adaptor, according to claim 8, wherein the depth of the top step is between approximately ½" and ¼" less than the depth of the offset distance.

11. A method for climbing, adapted for an extension ladder, the method comprising:

positioning the extension ladder for climbing, with a fly section of the extension ladder extended above a base section of the extension ladder;

placing a step adaptor, according to claim 1, against the extension ladder with the first upright and the second upright against side rails of the base section of the extension ladder;

positioning the top step of the step adaptor over a rung on the base section and positioning the plurality of lower steps of the step adaptor over corresponding lower rungs on the base section; and lowering the step adaptor until the rung channel in the top step and the rung channels in the plurality of lower steps are in contact with respective rungs in the base section.

12. The method, according to claim 11, further comprising:

sliding the overleaf of the top step and the overleaf of each of the plurality of lower steps over the underleaf of the top step and the underleaf of each of the plurality of lower steps, so as to adjust the width of the top step and the width of the plurality of lower steps.

* * * * *